US006065566A

United States Patent [19]

Brown et al.

[11] Patent Number: 6,065,566

[45] Date of Patent: May 23, 2000

[54] LADDER SAFETY BRACE

[76] Inventors: Michael J. Brown, 704 7th Ave. South, South St. Paul, Minn. 55075; Richard T. Brown, 746 Spring Hill Cir., Woodbury, Minn. 55125

[21] Appl. No.: 09/213,521

[22] Filed: Dec. 17, 1998

[51] Int. Cl.[7] ..... E06C 1/00

[52] U.S. Cl. ..... 182/172; 182/168; 182/107

[58] Field of Search ..... 182/172, 168, 182/165, 170, 171, 107

[56] References Cited

U.S. PATENT DOCUMENTS 1,496,201 6/1924 Baxter ..... 182/172 X 4,872,529 10/1989 Viets ..... 182/172

4,899,849 2/1990 Levi et al. ..... 182/172

5,511,632 4/1996 Ermis ..... 182/172

*Primary Examiner*—Daniel P. Stodola

*Assistant Examiner*—Hugh B. Thompson

*Attorney, Agent, or Firm*—Roger W. Jensen

[57] ABSTRACT

Apparatus for stabilizing a two-legged ladder against lateral and rearward movement. Telescoped tubular pole assemblies are attached at one end to opposite side rails of the ladder with a quick disconnect universal pivot. Special support and retainer blocks are provided for facilitating the transport of the assembled ladder and telescoped assemblies on the top of a vehicle.

1 Claim, 4 Drawing Sheets

FIG. 5
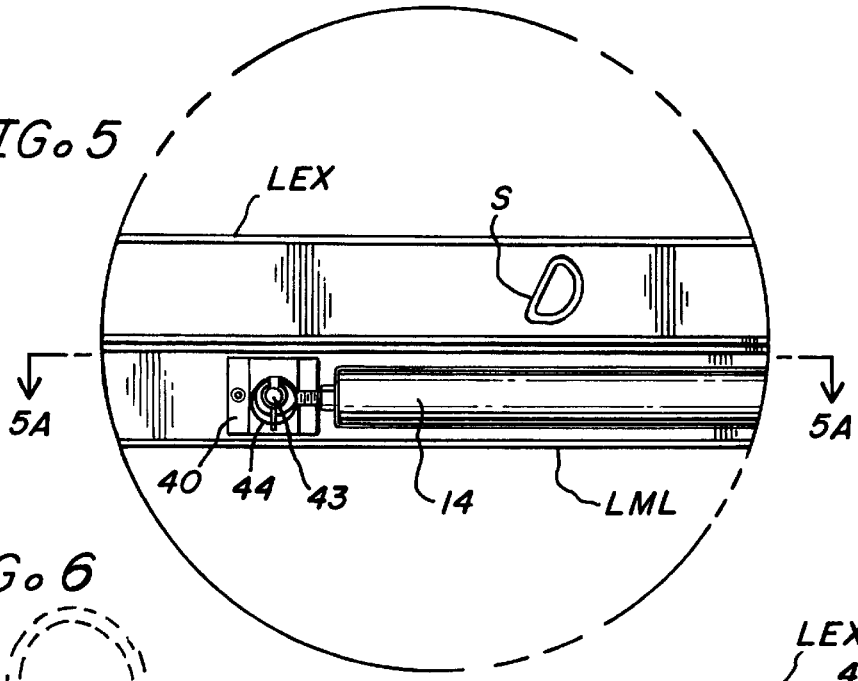
FIG. 6
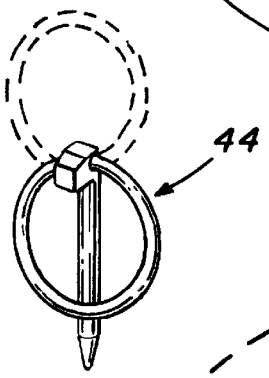
FIG. 4B
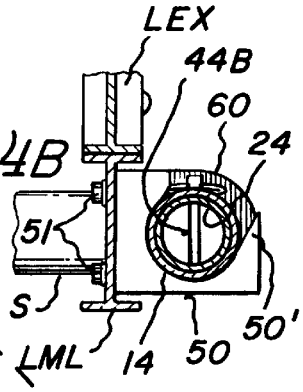
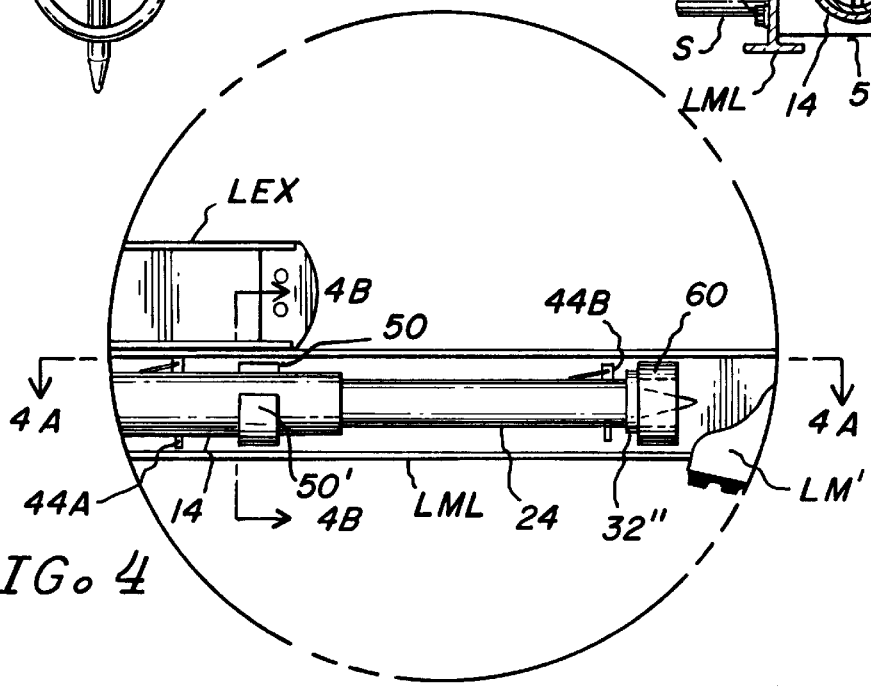
FIG. 4

LADDER SAFETY BRACE

BACKGROUND OF THE INVENTION

This invention relates to quick connect and quick disconnect braces for stabilizing a two-legged ladder, such as an extension ladder, to prevent the ladder from being blown over by a wind source, or pulling back off of the wall against which it is leaning, or spinning, i.e., pivoting, on one of the legs at the base of the ladder.

PRIOR ART ARRANGEMENTS

There are prior art stabilizers for extension ladders; examples are Levi, et al, U.S. Pat. No. 4,899,849 and the arrangements depicted in the several references cited in that patent. All of these prior art arrangements have shortcomings which have been overcome by our invention. For example, the Levi, et al. Pat. No. 4,899,849 has a rather complex system of braces which are attached at one end to the ladder and also comprise folding braces 58 and 60. This arrangement is difficult to install and is not easily and quickly detached from the ladder so as to permit the ladder to be used without the braces and/or transported to a different location without the awkward braces being attached.

It is therefore a principal object of the present invention to provide an improved ladder safety brace which may be quickly and safely attached and detached from the ladder.

Another object of this invention is to provide a pair of safety braces for an extension ladder, wherein each brace comprises a telescoping, tubular pole assembly of first and second members. The first member has a preselected length and universal pivot means at a first end thereof, connectable to a side rail of the extension ladder. The second member is telescoped with the first member and has a detachable foot piece at the "bottom" end thereof.

Another object of our invention is to provide a means for permitting a rapid disconnect of the safety braces from the ladder to remove the weight therefrom when the ladder is being moved from a first location to a second location.

Another object of the invention is to provide a means for facilitating the safe transport of the ladder on top of a vehicle such as a truck.

SUMMARY OF THE INVENTION

Our invention comprises left and right stabilizer attachment means connected respectively to the outer side surfaces of the left and right side rails of a two-legged ladder. Each of the stabilizer attachment means has a stub-shaft means connected to and projecting outwardly from the ladder side rails. The stub-shaft means is characterized by having means for receiving universal pivot means on the end of the first member of the assembly. Left and right elongated telescoped extendable tubular pole assemblies are provided respectively for the left and right side of the ladder. Each of the assemblies has a first and second member adapted to be telescoped one with respect to the other. The first member is characterized by having a preselected length, second universal pivot means at a first end thereof connectable to the stub-shaft means and held in rotatable relationship therewith by first holding pin means, and at least one transverse bore. The second member is characterized by having a preselected length and a plurality of spaced apart transverse bores, including a bore adjacent the first end thereof. The first and second members are selectively locked together at a plurality of relative longitudinal positions and are locked against any relative longitudinal movement by holding pin means inserted through transverse bores of the first and second members. Left and right support means for the first members are respectively connectable to the outer side surfaces of the left and right side rails of the ladder at a point preselected so that, when the first ends of the first members are connected to the stub-shaft means as aforesaid, then the other ends thereof may be selectively supported by said support means. The support means are especially functional to permit transport of the extension ladder in a horizontal orientation as, for example, on the top of a transport vehicle such as a truck. The invention further includes left and right retainer means for receiving and retaining the first end of the second member; the retainer means are respectively connected to the outer side surfaces of the left and right side rails of the extension ladder adjacent the ends thereof.

BRIEF DESCRIPTION OF THE DRAWINGS

FIG. 4 is an enlarged view of support means and retainer means for the assembly on the left side of the ladder;

FIG. 4B is detailed view of the apparatus shown in FIG. 4 as viewed along section lines 4B—4B;

FIG. 5 is an enlarged view of the connection between the first member 14 of the assembly, and the left side rail LM of the extension ladder;

FIG. 6 is an isometric view of a holding pin means which may be used with the invention;

DETAILED DESCRIPTION OF THE PREFERRED EMBODIMENT

Figure 1:
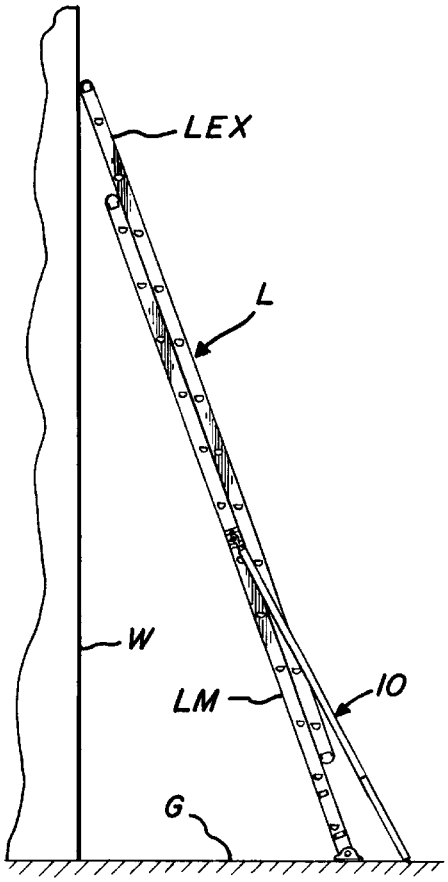
FIG. 1 is a side elevational view of an extension ladder incorporating the ladder safety braces of the present invention, the ladder being depicted with one end thereof on the ground and the other end abutting a wall of a building.
Figure 2:
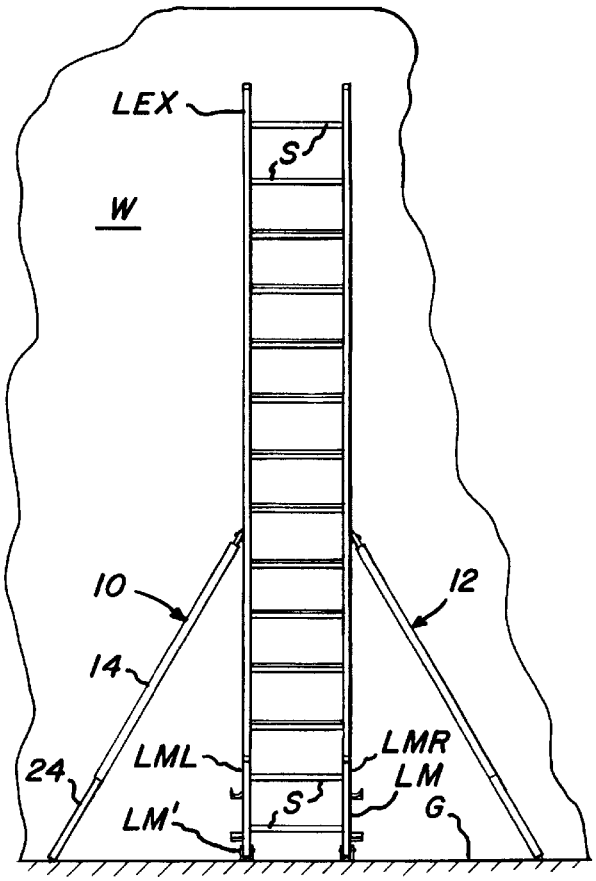
FIG. 2 is a front elevational view of the ladder shown in FIG. 1.

Referring to FIGS. 1 and 2, an extension ladder L having a main section LM and an extension section LEX is depicted with the bottom end of LM resting on the ground G and the top end of LEX is resting against a wall W of a building. Pivoted foot supports LM' at the base of LM provide a safe and secure support for supporting the ladder L. However, it is well recognized that even commercial grade ladders of the type described are subject to some hazards which can, if not addressed, can pose a risk to humans using the ladder and possible damage to property For example, a ladder such as ladder L could, when subjected to strong side winds, be blown over laterally. Another potential risk is that an individual climbing the ladder could cause a change in the center of gravity so as to cause the ladder to rotate away from the building as shown in FIG. 1, with the ladder operator, and the ladder per se, tumbling to the ground, with the obvious potential adverse consequences.

Each of the ladder sections LM and LEX includes a pair of side rails maintained in spaced relationship by plurality of transversely extending steps or rungs S. Thus, in FIG. 2, the left and right side rails of ladder section LM are respectively designated LML and LMR. Commercial grade ladders of the type described usually are made out of appropriate aluminum alloy having the requisite high strength characteristics. It should be understood, of course, that the present invention might be used with ladder sections fabricated from other materials, such as wood.

Figure 5A:
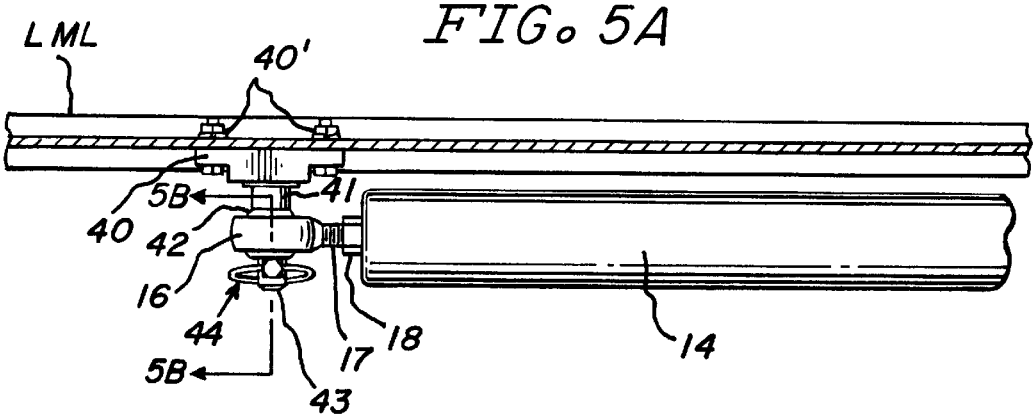
FIG. 5A is a view of the apparatus shown in FIG. 5 as viewed along cross section lines 5A—5A.
Figure 4A:
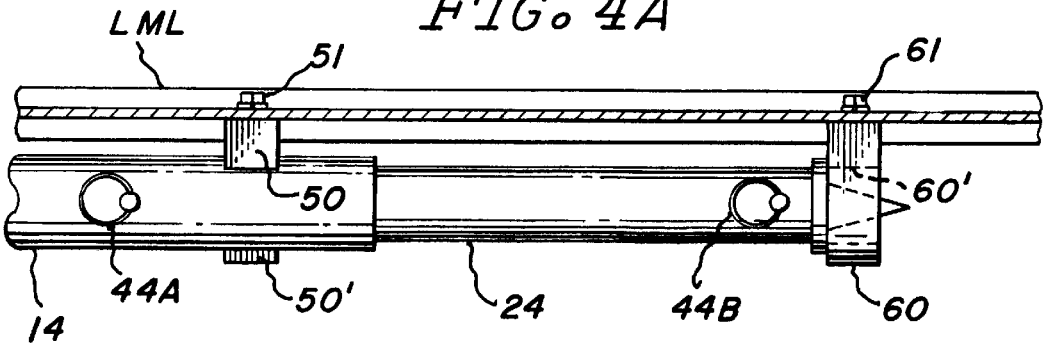
FIG. 4A is a detailed view of the apparatus shown in FIG. 4 as viewed along section lines 4A—4A.

The present invention provides left and right stabilizer attachment members respectively connected to the outer side surfaces of the left and right side rails of a ladder, each of the stabilizer attachment members having stub-shaft connected to and projecting outwardly and laterally from said side rails. The stub-shaft are further characterized by having means for receiving a universal pivot means on the end of the first member of the assemblies 10 and 12. Thus, referring to FIGS. 5 and 5A, the left side rail LML is shown as a support for a left stabilizer attachment members which comprises a base 40 abutted against LML and secured thereto by a pair of bolts with cooperating nuts 40'. Each stabilizer attachment members includes a stub-shaft members 41 extending normal or perpendicular to the longitudinal axis of the ladder section LML. Thus the stub-shaft 41 is connectable to and projects outwardly from the side rail LML, and is sized to receive universal pivot elements 42 and 16 adjacent the outer end 43 thereof. Universal pivot element 42 is shown in FIG. 5 to have a spherical shape and element 16 has a complementary curved surface. A first holding pin 44 (of the type shown in FIG. 6) is insertable through a bore 43AA at the end 43 of the stub-shaft 41 so as to hold universal pivot elements 42 and 16 on the shaft 41; this pivoting arrangement permitting the assemblies 10 and 12 to be rotatable away from a rest position such as is shown in FIG. 4A, to an operative position such as is shown in FIGS. 1 and 2.

The invention further comprises identical left and right elongated telescoped extendable tubular pole assemblies 10 and 12 (see FIGS. 1 and 2), each of the assemblies having a first and second member. In FIG. 2 the assembly 10 is shown to comprise a first member 14 telescoped with a second member 24. Referring to FIGS. 4 and 4A, it is seen that the first member 14 has a larger diameter than the second member 24 but it will be understood that the reverse relationship could be used. It will also be understood that the component parts of the assembly 12 are essentially identical to the component parts of assembly 10 which will now be discussed in further detail.

Figure 5B:
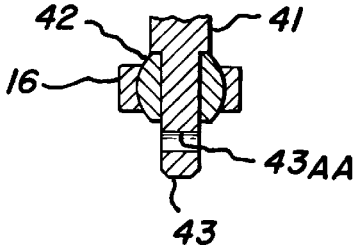
FIG. 5B is a view of the apparatus shown in FIG. 5A as viewed along section lines 5B—5B.
Figure 8:
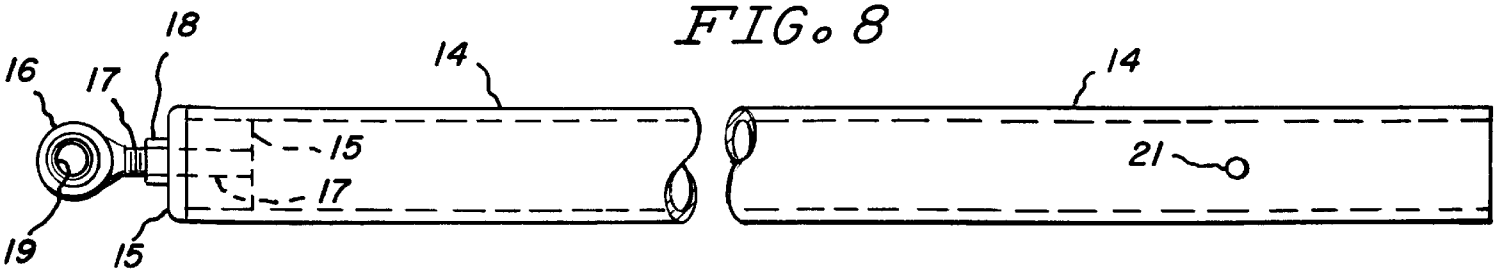
FIGS. 7 and 8 are views of the first and second members of the assembly.

The first or upper member 14 of assembly 10 is a tube characterized by having a preselected length with universal pivot elements 16 and 42 at a first or top end thereof adapted to be connected to the stub-shaft 41. The universal pivot elements 16 and 42 are best shown in FIGS. 5A, 5B and 8, wherein element 16 is depicted as being in the form of an eye bolt with an interior bore 19 being the inner bore of the element 42. The eye bolt has a threaded shank 17 adapted to be threaded into an end plug 15, secured to the end of the first member 14 and held against further rotation by a lock nut 18.

As shown in FIG. 8, the first member 14 further has at least one transverse bore 21.

Figure 7:
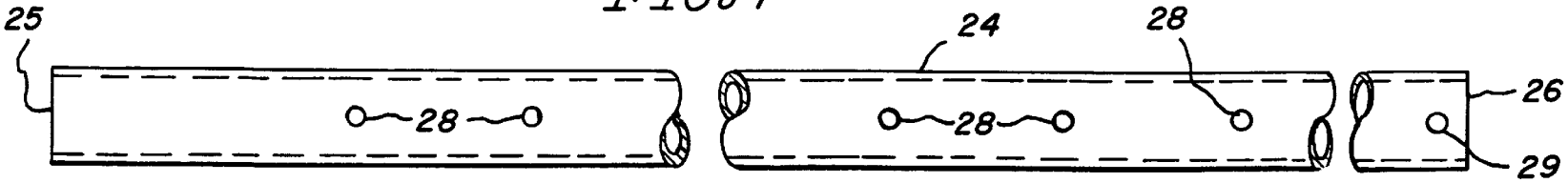

The second member 24 of the telescoped assembly 10 is shown in detail in FIG. 7 and comprises a tube with first and second ends 25 and 26, and has a plurality of spaced apart transverse bores 28, including a transverse bore 29 adjacent end 26 thereof. It will be understood that the inside diameter of the first member 14 is large enough to receive the outside diameter of the second member 24. The fit should be close enough to avoid excessive play, but yet permit free adjustment of members 14 and 24 relative to one another along their longitudinal axes.

A detachable end or foot piece is fitted into the end 26 of the second member 24. A pointed tip-type end or foot piece 32, shown in FIG. 9, has a shank portion 32' with a preselected diameter adapted to fit within the bore of the member 24. The point is identified by reference numeral 32''', and a shoulder portion 32'' has a diameter greater than shank portion 32'. A bore 33 in shank portion 32' is adapted to register with the transverse bore 29 and member 24, and a holding pin of the type shown in FIG. 6 may be used to pass through bores 29 and 33 and thus hold the pointed end or foot piece 32 with respect to the member 24 as is shown in FIGS. 4 and 4A wherein the holding pin means is identified by reference numeral 44B.

Figure 10:
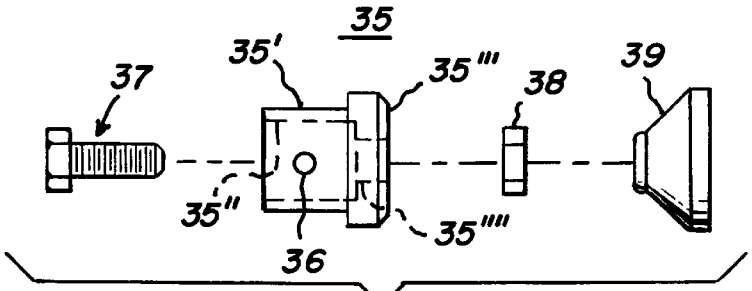
FIG. 10 is an exploded view of an alternate foot piece.

An alternate end or foot piece 35 is shown in FIG. 10, comprising a cylindrical body portion having an outer diameter 35' adapted to fit in the bore of member 24 at end 26 thereof. Member 35 further comprises an internal bore 35'' and an end section 35''' having a central longitudinal bore 35''' to permit passage therethrough of a threaded bolt 37 which is adapted to be threaded into an appropriate threaded recess in a base portion 39 and held in locked relationship by a lock nut 38. A transverse bore 36 is adapted to register with the transverse bore 29 of member 24 and held in place therewith by use of the holding pin means 44B.

Figure 9:
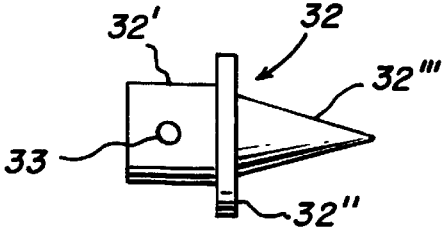
FIG. 9 is view of one of the detachable foot pieces for the assembly.

It will be understood that the choice of end or foot pieces 32 or 35 of FIGS. 9 or 10 respectively will be influenced by the type of surface upon which the ladder rests.

In operation, the ladder is first raised and positioned against the wall W as is shown in FIGS. 1 and 2. Then the assemblies 10 and 12 are adjusted in accordance with the terrain. It will be understood that the invention will accommodate installing the ladder on a sloped terrain. In all cases, the first and second members 14 and 24 are adjusted longitudinally with respect to each other so as to achieve the desired amount of extension so that the lower end of member 24 is contacting the ground at a desired location; then the members 14 and 24 are locked together by use of a holding pin means 44A passing through bore 21 of member 14 and one of the transverse bores 28 in member 24 as is shown in FIG. 4A.

It should be noted in FIG. 1 that the bottom end of the assembly 10 is further away from the building than the feet of the ladder. This is a very important relationship because it prevents the ladder from being pulled away from the wall W, and thus avoids the problem discussed above of the potential rotation of the ladder away from the building upon a person climbing the ladder and changing the center of gravity.

Figure 3:
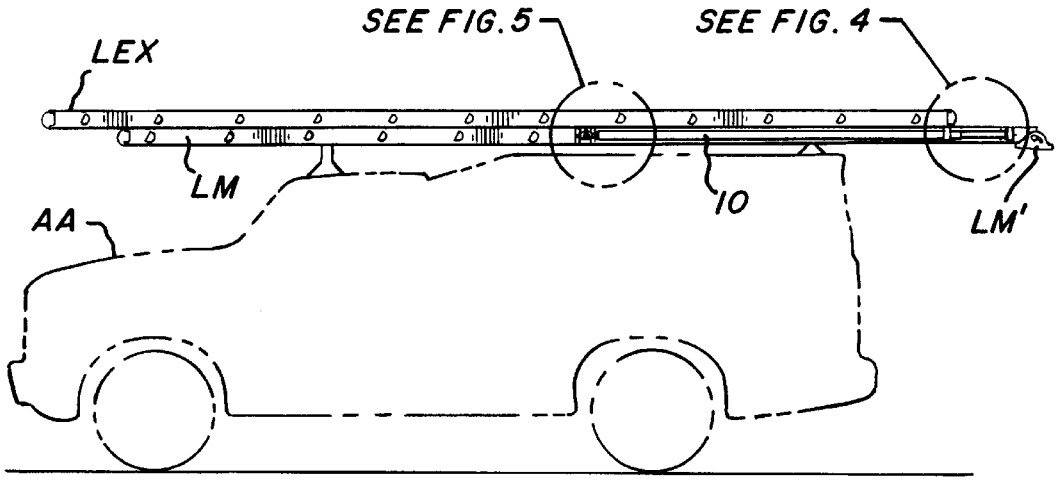
FIG. 3 is a view showing the ladder with attached ladder safety braces supported on the top of a motor vehicle.

Commercial ladders are frequently transported by vehicles from one location to another, sometimes on a daily or more frequent basis. The present invention provides a safe and efficient method of transporting an extension ladder on the top of a vehicle. Referring to FIG. 3, a vehicle AA is shown with an extension ladder supported on top of the vehicle. It will be noted that the main ladder section LM is closest to the roof of the vehicle, with the extension section LEX immediately above. The telescoped assembly 10 is shown and the right end thereof as depicted in FIG. 3 is shown in greater detail in FIGS. 4, 4A and 4B. The invention provides left and right support blocks for the first members of assemblies 10 and 12. The left support blocks, i.e., the support means for the left side rail LML is identified in FIGS. 4, 4A and 4B by reference numeral 50, comprising a block-like member attached to the side rail by bolt means 51 and having a hook portion or slot 50' therein for receiving the first member 14, the slot being shown best in FIG. 4B. Thus the telescoped members 14 and 24 can rest within the aforesaid slot 50' and are restrained against all motion except upward motion. It will be understood that the support blocks 50 is attached to the side rail LML at a point preselected so that when the universal pivot means 16 and 42 engages the stub-shaft 41, then the other end of member 14 may be supported by the support means 50 as is shown in FIGS. 4 and 4A.

As indicated, the support blocks 50 do not prevent the upward motion of the assembly (when the ladder is in a horizontal position such as is shown in FIG. 3). The telescoped assembly is retained in the horizontal position for this case by left and right retainer means for receiving and retaining the first end of the second member, the retainer means being respectively connected to the outer side surfaces of the left and right side rails adjacent one end thereof. The retainer means for the left side rail LML is shown in FIGS. 4 and 4A and is identified by reference numeral 60. The retainer means 60 comprises a block or flange extending outwardly from the side rail and secured thereto by bolt means 61, member 60 further including a bore 60' therethrough, having a preselected diameter so as to receive the point 32''' of the foot piece 32, but smaller than the diameter of the shoulder 32' of foot piece 32. Thus when it is desired to transport the ladder with the telescoped assemblies attached, the holding pin 44A will be temporarily removed so as to allow the pointed tip 32''' to be inserted into the bore 60' of retainer means 60. Then the holding pin 44A is reinserted through bores 21 and 28 as aforesaid. Thus the members 14 and 24 are supported by the support blocks 50 and retained, as aforesaid, by the retainer blocks 60.

It should be understood that it might be desired to detach or uncouple the telescoped assemblies from the ladder. It may be desired to transfer the telescoped assemblies to another ladder or it may be desirable to temporarily remove the telescoped assemblies from the ladder so as to reduce the total weight thereof in connection with movement of the ladder by a worker from a first to a second location. The present invention efficiently facilitates rapid disengagement of the telescoped assemblies from the ladders. This is accomplished simply by removing the holding pin 44 shown in FIGS. 5 and 5A. On removal of the holding pin 44, then the pivot means 16 and 42 can be readily decoupled from shaft 41.

While a preferred embodiment of the invention has been illustrated, it will be understood that variations may be made by those skilled in the art without departing from the inventive concept. Accordingly, the invention is to be limited only by the scope of the following claims.

We claim:

1. Apparatus for stabilizing a two-legged ladder against lateral and rearward movement, comprising in combination:

(i) left and right stabilizer attachment members respectively connectable to the outer side surfaces of the left and right side rails of a two-legged ladder, each of said stabilizer attachment members having a stub shaft connectable to and projecting outwardly from said side rails;

(ii) left and night elongated, telescopingly extendible tubular pole assemblies, each of said assemblies having a first member and a second member, said first member being characterized by having a preselected length, universal pivot elements at a first end thereof, said universal pivot elements comprising (a) a spherically-shaped element having a bore therethrough sized to receive said stub shaft, and (b) an eye-bolt element, rotatably connected to and coacting with said spherically-shaped element, and having a shank connected to said first end of said first member, said universal pivot elements being connected to said stub shaft with said stub shaft positioned in said bore of said spherically-shaped element, and held in rotatable relationship therewith by a first holding pin insertable through a bore at the end of said stub shaft, a ring connected to said first holding pin for removing said first holding pin from said bore at the end of said stub shaft, and said first member having at least one transverse bore, said second member being characterized by having a preselected length, and a plurality of spaced apart transverse bores including a bore adjacent a first end thereof, said first and second members being selectively locked together against relative longitudinal movement by a second holding pin inserted through said at least one bore of said first member and one of said plurality of spaced apart transverse bores of said second member;

(iii) left and right support blocks for said first members and respectively connectable to the outer side surfaces of said left and right side rails at a point preselected so that, when said first ends of said first members are connected to said stub shafts, the other ends thereof may be selectively supported by said support blocks; and (iv) left and right retainer blocks for receiving and retaining said first end of said second member, said retainer blocks being respectively connected to the outer side surfaces of said left and right side rails adjacent one end thereof, said retainer blocks each including a flange portion extending at an angle to said side rail with said flange portion having a bore therethrough, said second member having at said first end thereof a detachable foot piece having a tip adapted to co-act with and to be retained by said bore of said flange portion to thereby (a) prevent longitudinal movement of said second member relative to said first member, and (b) prevent said first and second members from movement with respect to said left and right side rails.

* * * * *